US011950731B2

(12) United States Patent
Alrutz

(10) Patent No.: US 11,950,731 B2
(45) Date of Patent: Apr. 9, 2024

(54) URINAL INTEGRATED LID SYSTEM

(71) Applicant: Joseph Henry Alrutz, Sunset Hills, MO (US)

(72) Inventor: Joseph Henry Alrutz, Sunset Hills, MO (US)

( * ) Notice: Subject to any disclaimer, the term of this patent is extended or adjusted under 35 U.S.C. 154(b) by 128 days.

(21) Appl. No.: 17/863,388

(22) Filed: Jul. 12, 2022

(65) Prior Publication Data

US 2022/0338687 A1 Oct. 27, 2022

Related U.S. Application Data

(63) Continuation-in-part of application No. 17/180,747, filed on Feb. 20, 2021, now abandoned.

(51) Int. Cl.
*A47K 13/08* (2006.01)

(52) U.S. Cl.
CPC ..... *A47K 13/08* (2013.01)

(58) Field of Classification Search
CPC ..... A47K 13/08
USPC ..... 4/300.3
See application file for complete search history.

(56) References Cited

U.S. PATENT DOCUMENTS

2008/0244817 A1* 10/2008 Saller ..... A47K 13/24 4/300.3

FOREIGN PATENT DOCUMENTS

WO WO-2019108185 A1 * 6/2019

* cited by examiner

*Primary Examiner* — Christine J Skubinna

(57) ABSTRACT

A urinal integrated lid system is provided which may utilize a toilet seat, a lower lid and an upper lid such that one or more hinges couple the toilet seat, the lower lid and the upper lid together. The system may further utilize a first coupling mechanism securing the lower lid to the upper lid and a second coupling mechanism secures the upper lid to a toilet water tank such that, after the second coupling mechanism secures the upper lid to the toilet water tank, a separation force may separate the lower lid from the upper lid. After separation of the lower lid from the upper lid, the lower lid may rotate via the one or more hinges through an angle range of 0 degrees to 75 degrees with respect to the upper lid.

20 Claims, 3 Drawing Sheets

URINAL INTEGRATED LID SYSTEM

CROSS-REFERENCE TO RELATED APPLICATIONS

This is a continuation-in-part of U.S. patent application Ser. No. 17/180,747, entitled "Urinal Integrated Lid System," filed Feb. 20, 2021. The contents of this application are hereby incorporated by reference in their entirety.

BACKGROUND OF THE INVENTION

Generally, bathrooms in office buildings or other public facilities utilize urinal toilets for male users equipped independently from conventional toilets to create a more user-friendly experience for male users as well as a hygienic environment by preventing urine spillage from reaching the floor and/or the user's clothing. Bathrooms in residential housing, apartments and condominiums do not utilize such urinal toilets due to cost and space constraints within the residence as well as unsightly aesthetic issues. Additionally, when male users urinate into a conventional toilet while in a standing upright posture, urine is often conveyed around the toilet bowl, toilet seat, toilet lid, the gap between the lid and the water tank, the floor, the walls and the user's clothing. Such circumstances can lead to unsanitary, offensive and even embarrassing situations for the user.

It would be advantageous to provide a convertible urinal lid for a conventional toilet bowl to improve the hygiene-related properties of the toilet bowl, toilet seat, and toilet lid. Further, it would be advantageous to provide a robust mechanism for standing-posture urination that does not suffer from any of the problems or deficiencies associated with standing urination into a water closet or into prior add-on urinal inventions. It would further be advantageous to provide a family friendly design that is easily used and operated by users of all ages, allowing urinal functionality to be economically integrated into any western bathroom, thus soliciting greater acceptance and consumer appeal than prior residential urinal devices have solicited.

DETAILED DESCRIPTION OF THE INVENTION

Figure 1:
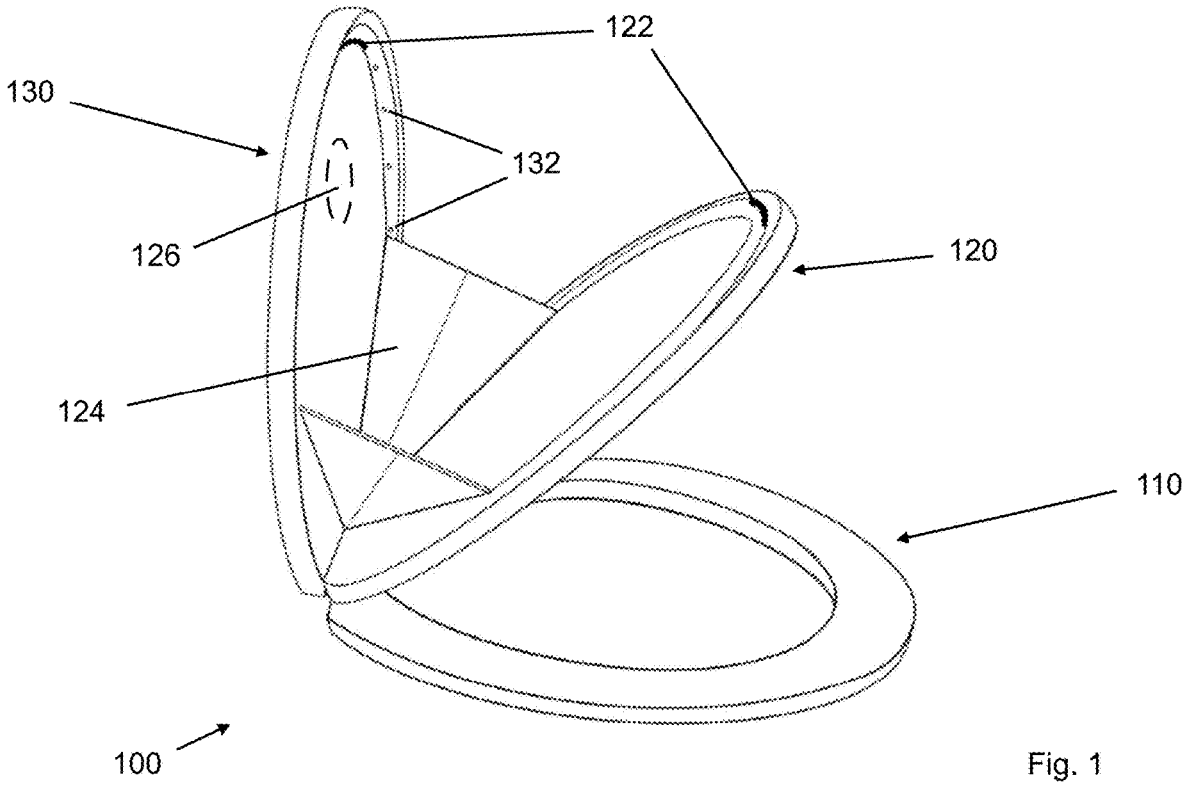
FIG. 1 illustrates a perspective view of a urinal integrated lid system in an open configuration in accordance with some embodiments of the present invention.

Before describing the present invention in detail, it is to be understood that the invention is not limited to any one of the particular embodiments, which of course may vary. It is also to be understood that the terminology used herein is for the purpose of describing particular embodiments only, and therefore is not necessarily intended to be limiting. As used in this specification and the appended claims, terms in the singular and the singular forms "a," "an," and "the" include plural referents unless the context clearly dictates otherwise. Thus, for example, reference to a "urinal integrated lid system" also includes a plurality of urinal integrated lid systems and the like.

In some embodiments, a urinal integrated lid system is provided comprising a toilet seat, a lower lid and an upper lid, wherein one or more hinges couple the toilet seat, the lower lid and the upper lid together; a first coupling mechanism secures the lower lid to the upper lid, wherein the first coupling mechanism applies a first securing force between the lower lid and the upper lid; and a second coupling mechanism secures the upper lid to a toilet water tank, wherein the second coupling mechanism applies a second securing force between the upper lid and the toilet water tank, and wherein the second securing force is greater than the first securing force, wherein, after the second coupling mechanism secures the upper lid to the toilet water tank, a separation force greater than the first securing force but less than the second securing force applied to the lower lid separates the lower lid from the upper lid, and wherein, after separation of the lower lid from the upper lid, the lower lid rotates via the one or more hinges through an angle range of 0 degrees to 75 degrees with respect to the upper lid.

In some embodiments, the second securing force is at least 1.5 times greater than the first securing force.

In some embodiments, the first coupling mechanism is one or more first magnets and the second coupling mechanism is one or more second magnets.

In some embodiments, the lower lid and the upper lid exist together in either an open state or a closed state relative one another.

In some embodiments, when in the closed state, the lower lid and the upper lid form a fluidically sealed cavity therebetween.

In some embodiments, the fluidically sealed cavity comprises a plurality of fluid outlet apertures disposed within one or more peripheral surfaces thereof.

In some embodiments, actuation of an actuator disposed on an exterior surface of the lower lid or the upper lid executes release of one or more cleansing fluids within the fluidically sealed cavity.

In some embodiments, a top portion of the fluidically sealed cavity releases the one or more cleansing fluids and a bottom portion of the fluidically sealed cavity drains the one or more cleansing fluids, and wherein the lower lid comprises a concave shape that slopes downwards from the top portion to the bottom portion.

In some embodiments, when in the open state, the lower lid and the upper lid are separated by an angle of between 45 degrees and 75 degrees relative one another.

In some embodiments, a plurality of foldable panels couple the lower lid to the upper lid, and wherein a fluid drain is disposed between the plurality of foldable panels.

In some embodiments, when the lower lid and the upper lid are in the closed state, the plurality of foldable panels exist in a folded state where each of the plurality of foldable panels are stacked upon one another.

In some embodiments, when the lower lid and the upper lid are in the open state, the plurality of foldable panels exist in an extended state where each of the plurality of foldable panels are arranged successively in a common plane.

In some embodiments, a urinal integrated lid system is provided comprising a toilet seat, a lower lid and an upper lid, wherein one or more hinges couple the toilet seat, the lower lid and the upper lid together; a first coupling mechanism secures the lower lid to the upper lid and a second coupling mechanism secures the upper lid to a toilet water tank, wherein, after separation of the lower lid from the upper lid, the lower lid rotates via the one or more hinges through an angle range of 0 degrees to 75 degrees with respect to the upper lid and an angle range of 15 degrees to 90 degrees relative the toilet seat; the lower lid and the upper lid exist together in either an open state or a closed state relative one another, wherein, when in the closed state, the lower lid and the upper lid form a fluidically sealed cavity therebetween, and wherein, when in the open state, the lower lid and the upper lid are separated by an angle of between 45 degrees and 75 degrees relative one another; and the fluidically sealed cavity comprises a plurality of fluid outlet apertures disposed within one or more peripheral surfaces thereof, wherein actuation of an actuator disposed on one or more exterior surfaces of the lower lid and the upper lid executes release of one or more cleansing fluids from the plurality of fluid outlet apertures.

In some embodiments, a urinal integrated lid system is provided comprising a toilet seat, a lower lid and an upper lid, wherein one or more hinges couple the toilet seat, the lower lid and the upper lid together, wherein the lower lid comprises a concave up shape and a surface that slopes downwards from a top portion to a bottom portion, and wherein the upper lid comprises a concave down shape; a first coupling mechanism secures the lower lid to the upper lid and a second coupling mechanism secures the upper lid to a toilet water tank, wherein, after separation of the lower lid from the upper lid, the lower lid rotates via the one or more hinges through an angle range of 0 degrees to 75 degrees with respect to the upper lid and an angle range of 15 degrees to 90 degrees relative the toilet seat; the lower lid and the upper lid exist together in either an open state or a closed state relative one another, wherein, when in the closed state, the lower lid and the upper lid form a fluidically sealed cavity therebetween, and wherein, when in the open state, the lower lid and the upper lid are separated by an angle of between 45 degrees and 75 degrees relative one another; and the fluidically sealed cavity comprises a plurality of fluid outlet apertures disposed within one or more peripheral surfaces thereof, wherein actuation of an actuator disposed on an exterior surface of the lower lid or the upper lid executes release of one or more cleansing fluids from the plurality of fluid outlet apertures, wherein the lower lid and the upper lid exist together in either a raised state or a lowered state relative the toilet seat, and wherein the fluidically sealed cavity releases the one or more cleansing fluids from the plurality of fluid outlet apertures only when the lower lid and the upper lid are together in the raised state.

Exemplary embodiments of the present invention are illustrated in the accompanying figures. As shown in FIG. 1, a perspective view of a urinal integrated lid system 100 is provided. The urinal integrated lid system 100 may comprise a seat 110, a lower lid 120 and an upper lid 130 which may each be coupled together at a first end via one or more hinges or the like. The one or more hinges may be coupled to a body of a toilet. The urinal integrated lid system 100 may further comprise a first coupling mechanism, a plurality of accordion-folded panels 124, a second coupling mechanism 126 and a plurality of fluid outlet apertures 132.

The lower lid 120 and the upper lid 130 may further be coupled to one another at a second end via the first coupling mechanism 122. The lower lid 120 and the upper lid 130 may be selectively secured to one another via the coupling mechanism 122 such that a user may iteratively remove the lower lid 120 from the upper lid 130 as desired. The coupling mechanism 122 may comprise one or more of a magnet, a releasable clasp, a latch, a patch of hook and loop fasteners, an actuator and the like. Further, each coupling mechanism 122 may be a portion of a coupling mechanism that together with one or more other portions of coupling mechanisms collectively form a functioning coupling mechanism. Additionally, each coupling mechanism 122 may each comprise one or more portions of a coupling mechanism that allow the coupling mechanism to function as a means of securing two or more elements together. Moreover, throughout this disclosure, any reference to a 'coupling mechanism' is understood to refer to a coupling mechanism that may comprise one or more portions that collectively make up the whole coupling mechanism, such as in the case of male and female coupling portions making up the whole coupling mechanism or as in the case of coopering magnetic coupling elements (for example, one or more magnetic material elements producing magnetic fields or one or more ferromagnetic material elements) that together make up the whole magnetic coupling mechanism.

Further, when the lower lid 120 and the upper lid 130 are raised relative the seat 110, the upper lid 130 may couple to an exterior surface of a water storage tank of the toilet via the second coupling mechanism 126. The second coupling mechanism 126 may be similar to or the same as that of the first coupling mechanism 122 in both form and function. Specifically, the second coupling mechanism 126 may comprise one or more of a magnet, a releasable clasp, a latch, a patch of hook and loop fasteners, an actuator and the like. Further, while the second coupling mechanism 126 is illustrated in FIG. 1 as having a thin planar strip-like shape, it is understood that the second coupling mechanism 126 may comprise any suitable shape such as, but not limited to, elongate, circular, ovular, elliptical, rectangular and the like or any combination thereof. Additionally, while the second coupling mechanism 126 is illustrated in FIG. 1 as being disposed at the second end of the upper lid 130 on a rear-side surface thereof, it is understood that the second coupling mechanism may be disposed at any location along the rear-side surface (i.e. the surface facing the water storage tank of the toilet) in order to accommodate the variable structures found in water storage tanks of toilets. In one embodiment, the second coupling mechanism 126 may comprise a magnet that comprises an elongate shape that is oriented vertically along the rear-side surface of the upper lid 130 such that the elongate vertically-oriented second coupling mechanism 126 may extend anywhere from the point where the accordion-folded panels 124 and the fluid outlet apertures 132 meet in the vertical dimension to the point where the first coupling mechanism is disposed. Such a configuration allows for the second coupling mechanism 126 to account for the variability in height of water storage tanks of a variety of toilets to ensure that the upper lid 130 can easily attach thereto via the second coupling mechanism 126. Additionally, the second coupling mechanism 126 may be disposed upon or within an exterior surface of the rear side of the upper lid 130 thereby allowing the second coupling mechanism 126 to be concealed within the upper lid 130 for aesthetic purposes while still functioning in the embodiment where a magnet is utilized.

The plurality of accordion-folded panels 124 may couple the lower lid 120 to the upper lid 130 at the first end and may be manipulated from a folded state to an extended state when the user chooses to selectively remove the lower lid 120 from securement to the upper lid 130. The panels 124 may be folded along one or more fold lines allowing the panels to move from the extended state to the folded state. Further, the panels 124 may be coupled to each of the lower lid 120 and the upper lid 130 at outer perimeter edges thereof and from there may taper towards the first end.

Additionally, the lower lid 120 and/or the upper lid 130 may comprise the plurality of fluid outlet apertures 132 disposed on an inner surface of the outer perimeter edges thereof. Specifically, the plurality of fluid outlet apertures 132 may be utilized to expel one or more fluids therefrom and thereby cleanse the surfaces of the lower lid 120 and/or the upper lid 130 of urination expelled by the user. Further, the plurality of fluid outlet apertures 132 may expel the one or more fluids such that the plurality of accordion-folded panels 124 funnel and collect the expelled fluids into one or more outlet drain apertures.

The number of the fluid outlet apertures 132 to be utilized on each of the lower lid 120 and the upper lid 130 may be on the range of between 1 and 30, but preferably between 5 and 25 and more preferably between 10 and 20. The diameter of each of the plurality of fluid outlet apertures 132 may be between 1-8 centimeters, but preferably between 2-6 centimeters, and more preferably between 3-4 centimeters.

Further, the plurality of fluid outlet apertures 132 may dispense the one or more fluids within a range of angles so as to properly cleanse the inner surfaces of the lower lid 120 and upper lid 130. Specifically, the range of angles may comprise a range between 45 degrees and 135 degrees, but preferably a range between 60 degrees and 120 degrees and more preferably a range between 75 degrees and 105 degrees. The specific angle that the plurality of fluid outlet apertures 132 dispense the one or more fluids may depend directly upon the number of fluid outlet apertures 132 utilized within the lower lid 120 and the upper lid 130.

It is preferred that the maximum amount of surface area of the inner surfaces of the lower lid 120 and the upper lid 130 receive fluid incident thereupon. Therefore, the greater the number of fluid outlet apertures 132 that are utilized then the smaller the fluid dispensation angle required from each of the fluid outlet apertures 132. Similarly, the lesser the number of fluid outlet apertures 132 that are utilized then the larger the fluid dispensation angle required from each of the fluid outlet apertures 132.

Larger numbers of fluid outlet apertures 132 that are utilized require additional production costs and larger fluid dispensation angles are harder to fabricated and so similarly require additional production costs. Therefore, the angle range between 75 degrees and 105 degrees is advantageous given it allows a reasonable amount of fluid outlet apertures 132 to be utilized while providing a fluid dispensation angle that is easily fabricated. Fluid dispensation angles substantially below 45 degrees would not cover enough surface area of the inner surfaces of the lower lid 120 and the upper lid 130 to properly cleanse the urinal integrated lid system 100 without requiring an unreasonable number of fluid outlet apertures 132.

The fluid plumbing allowing the fluid to be dispensed from the fluid outlet apertures 132 may be implemented in a manner so as to allow the inner surfaces of the lower lid 120 and the upper lid 130 to be maximally cleansed. Specifically, the lower lid 120 and/or the upper lid 130 may comprise one or more inner conduits disposed within the structure thereof and fluidically coupled to a water supply source such as, but not limited to, a water storage tank typically disposed at the rear of the toilet or directly into the toilet water supply. A constant supply of fluid pressure may be supplied to the inner conduits and controlled via an actuator valve.

A user may selectively release fluid from the fluid outlet apertures 132 by actuating the actuator valve. Specifically, the user may actuate the actuator valve by linearly depressing the actuator valve or by angularly rotating the actuator valve. Further, the extent to which the actuator valve is actuated may be directly proportional to the amount of fluid released from the fluid outlet apertures 132. For example, linear depression or angular rotation of the actuator valve may cause fluid passageways within the actuator valve to become fluidically aligned with the inner conduit and thereby allow the constant fluid pressure within the inner conduit to be released into peripheral passageways of the lower lid 120 and/or the upper lid 130 and dispensed from the fluid outlet apertures 132. Upon dispensation of the fluid from the fluid outlet apertures 132, the fluid may drain via an outlet conduit either directly into a grey water outlet conduit or directly into the bowl of the toilet.

Further, fluid may only be released from the fluid outlet apertures 132 when the lower lid 120 and the upper lid 130 are disposed together in a closed configuration where the lower lid 120 and the upper lid 130 form a fluidically sealed chamber therebetween. Allowing fluid to be released from the fluid outlet apertures 132 while the lower lid 120 and the upper lid 130 are disposed apart in an open configuration may cause contaminated fluids such as urine to be projected out of the urinal integrated lid system 100. Specifically, the fluidically sealed chamber may be formed via soft conformable materials disposed along the periphery of the lower lid 120 and/or the upper lid 130. For instance, the soft conformable materials may include, but are not limited to, PTFE, Nitrile, Neoprene, EPDM Rubber, Fluorocarbon, silicone and the like or any combination thereof. Further, the lower lid 120 and the upper lid 130 may be joined at the one or more hinges in a fluidically sealed configuration utilizing the same soft conformable materials as a type of o-ring disposed along the joining edge at the one or more hinges. Moreover, the panels 124 may comprise one or more fluid apertures disposed therein where the panels 124 adjoin to the lower lid 120 and the upper lid 130 at the one or more hinges in order to drain any fluid that collects outside of the panels 124 relative the location of the drain (see FIG. 2) during a flushing process of the fluidically sealed cavity.

Additionally, fluid may only be released from the fluid outlet apertures 132 when the lower lid 120 and the upper lid 130 in the closed configuration are together disposed in an upright configuration roughly orthogonal to a ground surface. Allowing fluid to be released from the fluid outlet apertures 132 when the lower lid 120 and the upper lid 130 are together disposed in a seated configuration roughly parallel to a ground surface may cause contaminated fluids such as urine to not fully drain out of the fluidically sealed chamber.

Preferably, the inner surface of the lower lid 120 may have a concave up shape to facilitate drainage of contaminated fluid even if the lower lid 120 and the upper lid 130 are disposed in the seated configuration. Further, the inner surface of the lower lid 120 may have a slanted surface when in the seated configuration such that the surface slants from the second end to the first end in order to facilitate drainage from the second end to the first end where the drain may be disposed. Additionally, the inner surface of the upper lid 130 may have a concave down shape to minimize splashing of expelled urine thereupon. In some embodiments, one or more of the inner surfaces of the upper and lower lids 120, 130 may comprise an anti-splash pad coupled thereto which may act as a target for the user when urinating so as to prevent splashing of expelled urine therefrom.

The seat 110, the lower lid 120, the panels 124 and the upper lid 130 may be made of any suitable material including, but not limited to, any type of any type of plastic, any type of metal, any type of ceramic, any type of porcelain, any type of rubber, any type of wood, any type of fiber-glass, any type of carbon-fiber, any type of synthetic material, any type of organic material, any type of inorganic material, porcelain, high-impact plastic, plastic-coated composite wood, polymer material, structural metal (e.g., structural steel or structural aluminum), co-polymer material, thermoplastic and thermosetting polymers, resin-containing material, polyethylene, polystyrene, polypropylene, epoxy resins, phenolic resins, Acrylanitrile Butadiene Styrene (ABS), Polycarbonate (PC), Mix of ABS and PC, Acetal (POM), Acetate, Acrylic (PMMA), Liquid Crystal Polymer (LCP), Mylar, PolyamidNylon, Polyamid-Nylon 6, Polyamid-Nylon 11, Polybutylene Terephthalate (PBT), Polycarbonate (PC), Polyetherimide (PEI), Polyethylene (PE), Low Density PE (LDPE), High Density PE (HDPE), Ultra High Molecular Weight PE (UHMW PE), Polyethylene Terephthalate (PET), PolPolypropylene (PP), Polyphthalamide (PPA), Docket No. 2019JL-WETS Polyphenylenesulfide (PPS), Polystyrene (PS), High Impact Polystyrene (HIPS), Polysulfone (PSU), Polyurethane (PU), Polyvinyl Chloride (PVC), Chlorinated Polyvinyl chloride (CPVC), Polyvinylidenefluoride (PVDF), Styrene Acrylonitrile (SAN), Teflon TFE, Thermoplastic Elastomer (TPE), Thermoplastic Polyurethane (TPU), and/or Engineered Thermoplastic Polyurethane (ETPU) or other similar materials and any combinations thereof.

Any method may be used to construct the seat 110, the lower lid 120, the panels 124 and the upper lid 130 including, but not limited to, hollow or solid fill, casting, injection molding, vacuum-forming, hydro-forming, welding, gluing, bonding, die-cut, extrusion, ABS plastic injection molding, PP plastic injection molding, duraplast compression molding and the like or any combination thereof.

Figure 2:
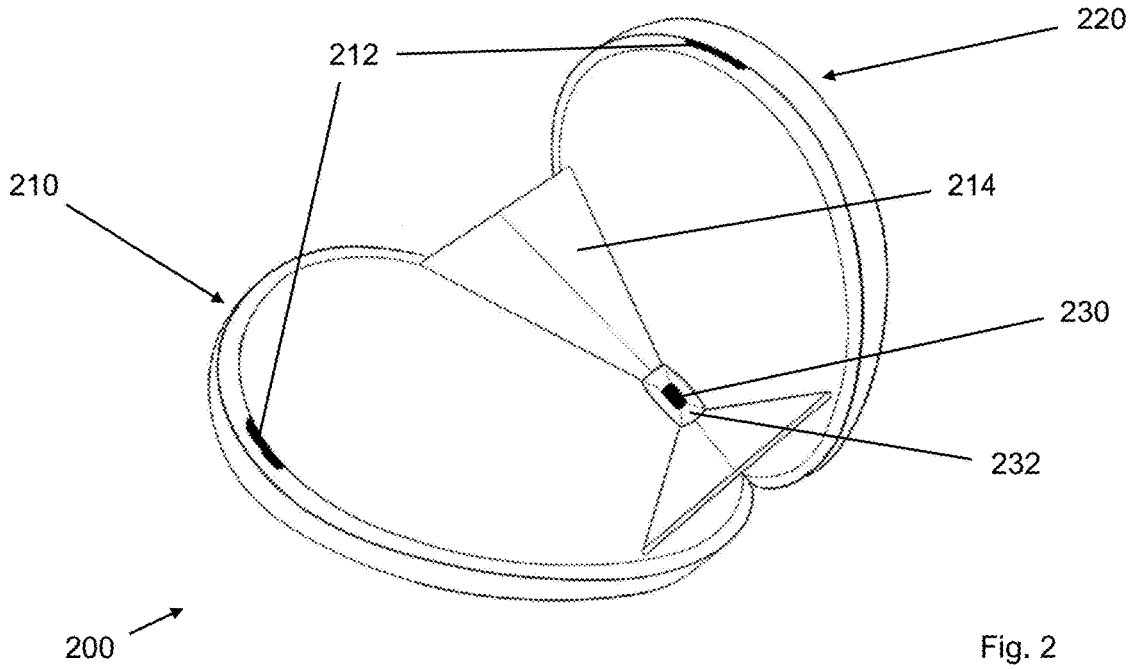
FIG. 2 illustrates an overhead view of an expandable lid of a urinal integrated lid system in an open configuration in accordance with some embodiments of the present invention.

As shown in FIG. 2, an overhead view of an expandable lid 200 of the urinal integrated lid system 100 in an open configuration is provided. The expandable lid 200 may comprise a lower lid 210 and an upper lid 220 coupled together via a coupling mechanism 212 and a plurality of accordion-folded panels 214. The lower lid 210 and the upper lid 220 may be selectively secured to one another via the coupling mechanism 212 such that a user may iteratively remove the lower lid 210 from the upper lid 220 as desired in order to manipulate the expandable lid 200 between open and closed configurations. The coupling mechanism 212 may comprise one or more of a magnet, a releasable clasp, a latch, a patch of hook and loop fasteners, an actuator and the like.

Further, a plurality of fluid outlet apertures may expel one or more fluids such that the plurality of accordion-folded panels 214 funnel and collect the expelled fluids into one or more outlet drain apertures 230. The plurality of fluid outlet apertures may expel the one or more fluids while the expandable lid 200 is in either of the open or closed configurations.

The one or more outlet drain apertures 230 may compose a funneling structure 232 disposed therearound in order to permit drainage of excess liquids including cleansing fluids and expelled urine. The funneling structure 232 is important to prevent potentially hazardous buildup of expelled urine after the user has utilized the expandable lid 200. Freshly expelled urine is considered largely sterile, but urine can become hazardous to the human body upon it beginning to dry.

Therefore, the funneling structure 232 may comprise a contoured shape that tapers downward toward the outlet drain aperture 230 to prevent expelled cleansing fluid and/or user-expelled urine from splashing up and out of the confines of the lower lid 210, upper lid 220 and accordion-folded panels 214. The funneling structure 232 may couple to a first end of the lower lid 210, the upper lid 220 and the accordion-folded panels 214 in order to create a liquid seal for the expelled cleansing fluid and/or user-expelled urine.

Each of the lower lid 210 inner surface, the upper lid 220 inner surface, the accordion-folded panel 214 inner surfaces and the funneling structure 232 may comprise one or more hydrophobic coatings disposed thereupon in order to more efficiently allow expelled cleansing fluid and urine to pass through to the outlet drain aperture. Much like the shape of the funneling structure 232, the inner surfaces of the lower lid 210 and the upper lid 220 may comprise a concave up surface shape or a concave down surface shape in order to minimize splashing of expelled cleansing fluid and urine up and out of the confines of the lower lid 210, upper lid 220 and accordion-folded panels 214. Specifically, a concave surface dampens the reflective splashing force of incident liquids such as the expelled cleansing fluid and urine.

The outlet drain aperture 230 may be positioned in the urinal to allow the user's urine and the cleansing fluid to drain directly into the general grey water outflow pipe by bypassing the bowl via a conduit disposed therebetween. The outlet drain aperture 230 may further comprise at least one hole sized to prevent loose debris from clogging the conduit. Additionally, the outlet drain aperture 230 may comprise a debris screen to prevent large particulate matter from clogging the conduit.

Any component of the expandable lid 200 may utilize one or more chemical beads. Preferably, the chemical beads may comprise waterless urinal beads or chlorine beads to help prevent the occurrence of unpleasant odors. The diameter of each bead may range between 1 to 9 centimeters, and preferably the diameter of each bead is larger than the diameter of the holes such that the beads do not quickly fall through the holes thereby negating their effect.

Figure 3A:
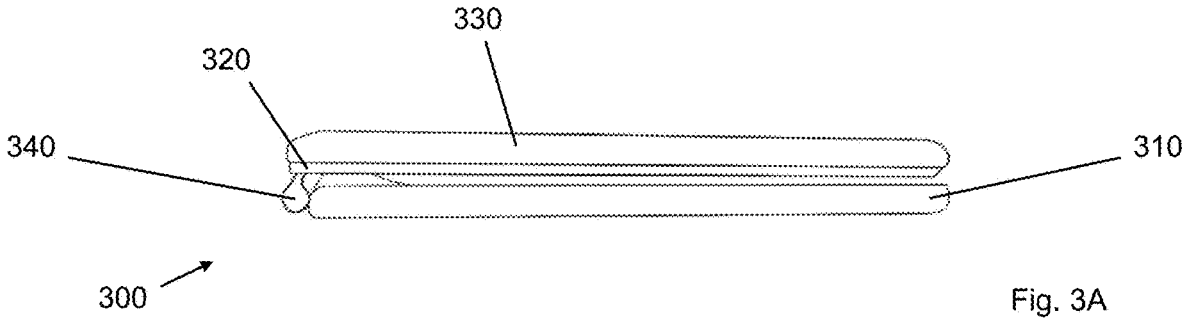
FIG. 3A illustrates a side view of an expandable lid of a urinal integrated lid system in a closed configuration in accordance with some embodiments of the present invention.

As shown in FIG. 3A, a side view of an expandable lid 300 of the urinal integrated lid system 100 in a closed configuration is provided. The expandable lid 300 comprises a seat 310, a lower lid 320 and an upper lid 330 each coupled to one another at a first end via a hinge 340. The hinge 340 may comprise a plurality of individual hinges each coupled to one another in such a manner as to allow one or more rotational degrees of freedom therebetween.

Specifically, each of the plurality of individual hinges may be coupled to one of the seat 310, the lower lid 320 and the upper lid 330 to allow each to rotate independently of one another. Such a configuration allows for rotation of the seat 310 relative the lower lid 320 and the upper lid 330 between a range of 0 degrees to 135 degrees, thereby allowing a user to lift the lower lid 320 and the upper lid 330 to gain access to the interior of the toilet bowl.

Further, such a configuration allows for rotation of the lower lid 320 relative the upper lid 330 between a range of 45 degrees to 75 degrees. This range of rotation between the lower lid 320 and the upper lid 330 allows for an adequate opening to form therebetween which provides the ability for a user to expel urine therein. Further, if the upper lid 330 forms an angle of 90 degrees with the seat 310, then a maximum angle of 75 degrees between the lower lid 320 and upper lid 330 will provide the user with a maximal opening within which to expel urine but also will still maintain the lower lid 320 at an inclined angle of 15 degrees relative the seat which allows gravity to drain the expelled urine down toward the outlet drain aperture 230 as shown in FIG. 2.

Angle ranges of greater than 135 degrees between the seat 310 and the lower and upper lids 320, 330 would likely not be possible given the typical arrangement of the water tank and toilet bowl would block greater angle ranges. Additionally, angle ranges of less than 0 degrees between the seat 310 and the lower and upper lids 320, 330 would not be possible given each of these structural elements are designed to rest upon the toilet bowl.

Angle ranges of greater than 75 degrees between the lower lid 320 and the upper lid 330 would result in expelled urine not efficiently flowing toward the outlet aperture 230 as shown in FIG. 2 and may lead to contamination of the toilet structure with spilled urine which, upon drying, can become hazardous to the human body. Further, angle ranges of less than 45 degrees between the lower lid 320 and the upper lid 330 would not allow for an adequate opening within which to expel urine and thereby may similarly lead to contamination of the toilet structure and surrounding bathroom surfaces with spilled urine.

In the closed configuration, the seat 310, the lower lid 320 and the upper lid 330 may collectively form a fluid seal with the toilet bowl upon which they rest. This fluid seal may allow for one or more odor-prevention techniques to be utilized including, but not limited to, ozone treatment, fluid evacuation of noxious odors and the like.

Figure 3B:
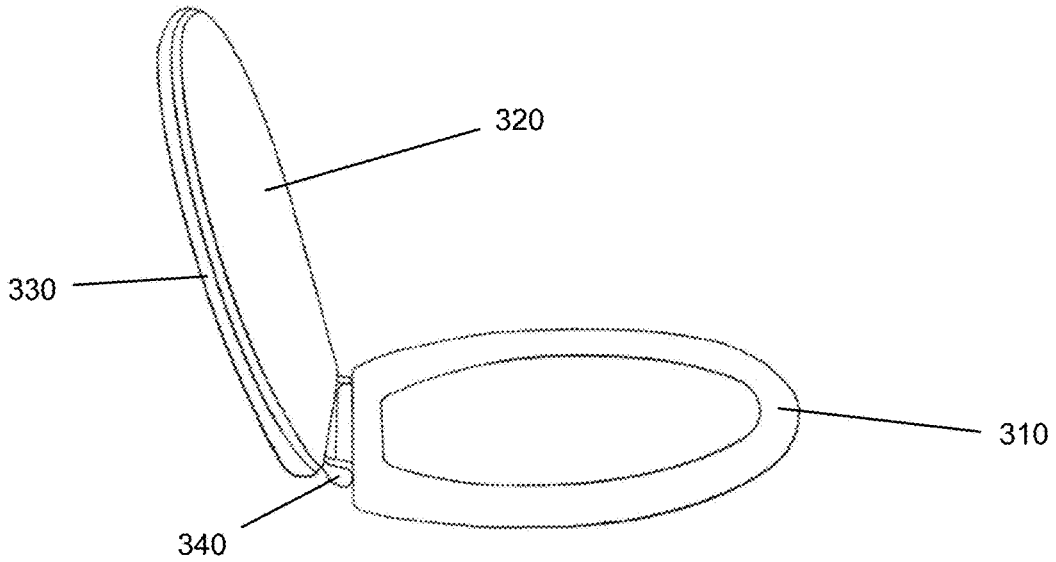
FIG. 3B illustrates a side view of an expandable lid of a urinal integrated lid system in a raised configuration in accordance with some embodiments of the present invention.

As shown in FIG. 3B, a side view of an expandable lid 300 of the urinal integrated lid system 100 in a raised configuration is provided. In the raised configuration, the lower lid 320 and the upper lid 330 remain coupled together and therefore are arranged at a common angle relative the seat 310, thereby allowing a user to utilize the seat 310 when the user desired to sit down thereupon when using the toilet.

Figure 3C:
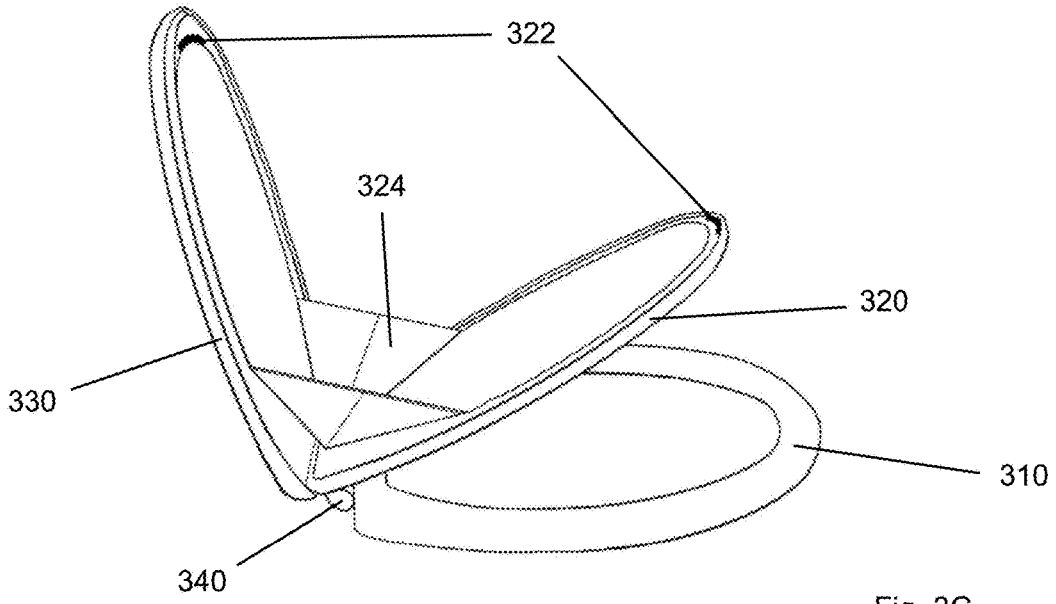
FIG. 3C illustrates a side view of an expandable lid of a urinal integrated lid system in an open configuration in accordance with some embodiments of the present invention.

As shown in FIG. 3C, a side view of an expandable lid 300 of the urinal integrated lid system 100 in an open configuration is provided. After being placed into the raised configuration of FIG. 3B, the upper lid 330 may be secured to the water tank of the toilet that is typically disposed behind the upper lid 330 when in the raised configuration. Such securement may be executed utilizing one or more magnets, hook and loop fasteners, clasping mechanisms, latching mechanisms and the like disposed upon an outer surface of the upper lid 330.

Once the upper lid 330 is secured to the water tank, the user may apply force to the lower lid 320 in order to remove its coupling from the upper lid 330. Specifically, the securing force of the upper lid 330 to the water tank must be greater than the securing force of the upper lid 330 to the lower lid 320 in order to allow the user the apply force to decouple the lower lid 320 from the upper lid 330. Preferably, the securing force of the upper lid 330 to the water tank may be at least 1.25 times the securing force of the lower lid 320 to the upper lid 330. Such a proportion accounts for the user error in applying too much force to the lower lid 320 and accidentally decoupling the upper lid 330 from the water tank as well.

The lower lid 320 may be coupled to the upper lid 330 by a plurality of accordion-folded panels 324. Specifically, the accordion-folded panels 324 may comprise a plurality of sections that fold upon one another to allow the lower lid 320 to be secured to the upper lid 330 in both the open and closed configurations as described in FIG. 2. While the accordion-folded panels 324 are shown in FIG. 3C to be coupled to the lower lid 320 and the upper lid 330 at lower portions thereof, the panels 324 may be coupled to the lids 320, 330 at any suitable portion thereof. Preferably, the panels 324 may be coupled to the lids 320, 330 at an upper portion thereof and taper down towards the outlet drain aperture 230 of FIG. 2 in order to provide a larger confined area within which to retain expelled urine and thereby minimize the amount of spillage of expelled urine.

Figure 4:
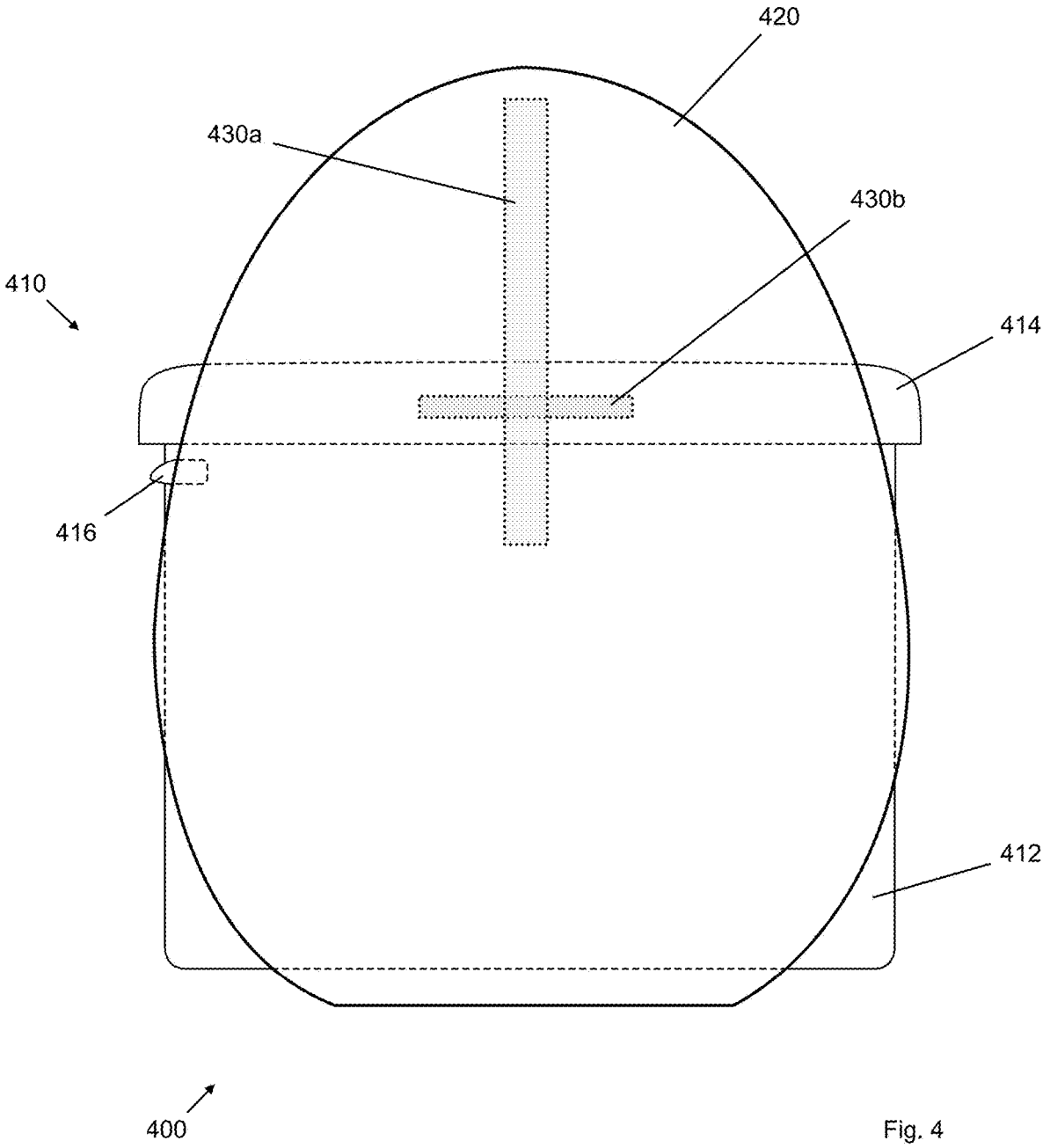
FIG. 4 illustrates an elevational view of an upper lid of a urinal integrated lid system coupled to a toilet water storage tank in accordance with some embodiments of the present invention.

As shown in FIG. 4, an elevational view of an upper lid 420 of a urinal integrated lid system 400 coupled to a toilet water storage tank 410 is provided. The urinal integrated lid system 400 may comprise the upper lid 420 having a first magnetic coupling mechanism 430*a*. The first magnetic coupling mechanism 430*a* may magnetically couple to a second magnetic coupling mechanism 430*b* that is attached to a toilet water storage tank 410. Specifically, the second magnetic coupling mechanism 430*b* may be coupled to the base 412 of the toilet water storage tank 410 or may be coupled to the lid 414 of the tank 410. The second coupling mechanism 430*b* will not interfere with the flushing element 416 of the toilet water storage tank 410. In some embodiments, the first magnetic coupling mechanism 430*a* may be arranged in a vertical manner upon or within a rear side (the side facing the toilet water storage tank 410) of the upper lid 420. Since the urinal integrated lid system 400 may be designed as an after-market consumer good that replaces a toilet lid system of an existing toilet system, the elongate vertical configuration of the first magnetic coupling mechanism 430*a* may be advantageous in order to accommodate the variety of shapes and heights of existing consumer toilet water storage tanks 410, thereby increasing the applicability and relevance of the system 400 to a wider range of potential end-users within the market. Further, the second magnetic coupling mechanism 430*b* may be arranged in a horizontal manner upon a front side (the side facing the upper lid 420) of the toilet water storage tank 410. The elongate horizontal configuration of the second magnetic coupling mechanism 430*b* may be advantageous in order to provide the greatest error tolerance for attaching to the vertical arrangement of the first magnetic coupling mechanism 430*a*. The second magnetic coupling mechanism 430*b* may applied by the user to the toilet water storage tank 410 of their existing toilet system and, therefore, it is advantageous that the greatest error tolerance be provided to make the job of placing the second magnetic coupling mechanism 430*b* upon the tank 410 as user-friendly as possible. Since it most common for the upper lid 420 to fall incident upon the storage tank lid 414 in the raised configuration, FIG. 4 illustrates as much. However, it is understood that the upper lid 420 may fall incident upon the base 412 of the tank 410 and so the user may desire to place the second magnetic coupling mechanism 430*b* upon the base 412 accordingly. The second magnetic coupling mechanism 430*b* may be coupled to the tank 410 via one or more of adhesive layers, suction cup elements and the like or may be held in place via a flange being placed between the lid 414 and the base 412. It would be advantageous for the securing force of the second magnetic coupling mechanism 430*b* to the tank 410 to be greater than the securing force between the first and second magnetic coupling mechanisms 430*a*, 430*b* in order to allow the user to remove the upper lid 420 from the tank 410 without removing the second magnetic coupling mechanism 430*b* as well. Similarly, with reference to FIG. 1, it would be advantageous for the securing force between the first and second magnetic coupling mechanics 430*a*, 430*b* to be greater than that of the securing force between the coupling mechanisms 122 of the upper and lower lids 120, 130, thereby allowing the user to decouple the lids from one another without decoupling the upper lid 130, 420 from the tank 410. In sum, it is advantageous for the securing force of the second magnetic coupling mechanism 430*b* to the tank 410 to be greater than the securing force between the first and second magnetic coupling mechanisms 430*a*, 430*b* which itself is advantageously greater than the securing force between the coupling mechanisms 122 of the upper and lower lids 120, 130. It may be advantageous that each securing force in the aforementioned configuration be at least 1.25 times greater than the successive securing force in order to provide a large enough buffer between securing forces to prevent issues for the user in easily separating the various magnetic coupling mechanisms from one another. In this context and throughout this disclosure, any reference to a securing force is understood to refer to a separation force required to separate one or more portions of a coupling mechanism from one another. Each of the magnetic coupling mechanisms 430*a*, 430*b* may be made from magnetic material naturally producing a magnetic field or from ferromagnetic materials susceptible to magnetic forces. For instance, the first magnetic coupling mechanism 430*a* may be made from one or more magnetic materials such as iron ore, nickel, cobalt, samarium, neodymium, boron, aluminum and the like or any combinations thereof whereas the second magnetic coupling mechanism 430*b* may be made from one or more ferromagnetic materials such as, iron, steel, nickel, cobalt and the like or any combination thereof. Additionally, the first and second magnetic coupling mechanisms 430*a*, 430*b* are illustrated in FIG. 4 as being single elements, but it is understood that each mechanism 430*a*, 430*b* may represent a plurality of elements achieving the same aim. For instance, the first and second magnetic coupling mechanisms 430*a*, 430*b* may themselves each comprise a plurality of magnetic coupling mechanisms.

A urinal integrated lid combined with a toilet seat according to the present invention aims to solve the following problems. First, it is possible to prevent the excessive use of water throughout each flush by flushing urine from the toilet without flushing the entire toilet and thereby reducing overall water consumption and water bills. Second, it aims to prevent infectious diseases caused by the scattering of urine and to enable sanitary control of urination collection systems. Third, the present invention is to prevent the scattering of urine and the noise associated therewith. Fourth, the present invention allows urination in both a standing state and a seated state. The solution to the problem of the present invention is not limited to those mentioned above, and other solutions not mentioned can be clearly understood by those skilled in the art from the disclosed description.

An improved toilet lid includes features to offer a built-in foldable urinal integrated with a toilet lid system that can be installed onto existing toilets. The invention comprises a main body, a urinal, an inlet, and an outlet. The main body comprises a toilet seat. The urinal comprises a lower urinal lid, a coupling, at least two or more foldable urinal side panels and an upper urinal lid. The inlet may attach to a waterline outside of the toilet or inside of the toilet to allow flushing of the urinal. The outlet may be positioned in the urinal to allow the user's urine and the flushing water to be drained through the outlet. The outlet may be positioned in the urinal to allow the user's urine and the flushing water to be drained through the outlet to the drain of the toilet by bypassing the bowl via a hose disposed therebetween. Preferably, the outlet is positioned on a urine base positioned at the bottom of the lower urine lid, the upper urine lid and the at least two or more foldable urinal side panels. Alternatively, the inlet and outlet may be disposed at the rear of the upper lid and the lower lid. The outlet may comprise a plurality of small holes to prevent loose debris from clogging the urinal. The outlet may further comprise a debris screen to prevent loose debris from clogging the urinal. The outlet may comprise chemical beads on top of the plurality of holes.

The urinal integrated lid system may be used as a dry system and/or a wet system. The urinal integrated lid system may have at least one switch or button. When the urinal integrated lid system is used as a wet system, at least one button or switch may be activated for the flushing action to commence. The button may comprise a spring-actuated button to selectively allow flushing or liquid to pass therethrough based upon actuation of the button. Upon actuation of the button by pressing the spring-actuated button inward/downward into the upper lid, an inlet becomes aligned with an outlet, thus allowing cleansing water to flow therethrough. Preferably, the inlet and outlet comprise a washer or bearing or sealing ring disposed therebetween to ensure there is no leaking while the button is actuated up and down.

With regard to FIGS. 1-4, any magnet or magnetic material utilized in the urinal integrated lid system may comprise a magnetic force that the average user would find easy to work with. For instance, each magnet or magnetic material (regardless of their size, dimensions and shape) may comprise a magnetic field strength of between 0.0001 Tesla and 0.01 Tesla, but more preferably between 0.0005 Tesla and 0.005 Tesla. Such a value range will ensure that the user of the system will be able to remove the upper and lower lid magnetic coupling mechanisms (see FIG. 1 for example) from one another and to remove the upper lid magnetic coupling mechanism from the toilet water storage tank magnetic coupling mechanism (see FIG. 4 for example) without undue physical burden upon the user or without incurring danger from the process. Each of the magnets or magnetic materials utilized in the urinal integrated lid system should allow the user to easily decouple magnetic coupling mechanisms from one another while still achieving their purpose of retaining the upper lid and lower lid in their various configurations between the 0 and 90 degree rotational positions described in each of FIGS. 1-4. In any embodiments where patches of hook and loop fasteners are utilized, the equivalent ranges of force may be utilized therewith. Accordingly, each patch of hook and loop fasteners may comprise a separation force of between 1 pound and 10 pounds.

The urinal integrated lid system may comprise at least one power source at least in part for powering a light source. The light source may be positioned anywhere on the lid system to provide night lighting and lighting patterns to help aim or entertain the user. Preferably, the light source may include LEDs to provide energy efficient lighting and low profile/compact lighting to increase the space efficiency of the lid system. The power source may include batteries, solar cells, thermoelectric generators and the like. In some embodiments, the toilet seat may have any suitable dimensions and various designs (elongated, round, oval-shaped, C-shaped, standard shape etc.). Elongated toilets tend to be more comfortable for adults and easier to get off of for those with mobility issues, but they take up more room and are a bit restricting in a small bathroom. Round toilets are better for smaller people and could be an ideal solution for a child's bathroom. They are less powerful on average than elongated models, but are more cost-effective.

In some embodiments, the outlet may be positioned in the urinal to allow the user's urine and the flushing water to be drained through the outlet to the drain of the toilet by bypassing the bowl via a hose disposed therebetween. Preferably, the outlet is positioned on a urine base positioned at the bottom of the lower urine lid, the upper urine lid and the at least two or more foldable urinal side panels. Alternatively, the inlet and the outlet may be disposed at the rear of the upper lid and the lower lid.

The number of holes in the outlet and/or in the lids may range between 1-10,000. The diameter of each hole may range between 1 millimeter and 5 centimeters. Preferably, the chemical beads may comprise waterless urinal beads or chlorine beads to help prevent the occurrence of unpleasant odors. The diameter of each bead may range between 1 millimeter and 5 centimeters, preferably the diameter of each bead is larger than the diameter of the holes such that the beads do not quickly fall through the holes being ineffective. More preferably, the chemical beads may be held in place by a mesh grill or the like either at the outlets or at the actuator valve so as to dispense the chemical to all outlets.

The outlet comprising at least one hole may be positioned in the urinal base. If the outlet comprises a plurality of holes, it may be advantageous to position the holes in a particular pattern to optimize fluid flow while preventing large debris to pass and potentially clog the urinal. The outlet comprising at least one hole may incorporates one or more shapes including a circle, triangle, square, and the like. The at least one hole may incorporate customizable shapes to include simple shapes to complex shapes to provide the user with appealing designs.

In some embodiments, urinal base may have a planar surface or a contoured surface. A urinal base having a planar surface may comprise a rectangular shape, parallelogram shape, triangular shape, circular shape, oval shape or the like has the advantages of a simpler, more compact and more cost-effective design. A urinal base having a contoured surface may comprise a conical/funnel-type shape, hemispherical shape or the like and thereby provide the advantages of focusing or guiding the liquids to the outlet such that very little contaminating fluids may be left behind. The urinal base may also be angled to reduce scattering of urine/liquids during use. The urinal base, which may be formed of molded plastic, may comprise a substantially planar thin floor member, an outlet having at least one hole and the substantially planar thin floor member connected to the foldable urinal sidewalls, the lower lid and the upper lid.

In some embodiments, male and female users of different heights urinating into the urinal integrated lid system may be comfortably accommodated by adjusting the urinal integrated lid to have an adjustable height range. The adjustable height range may be defined from the upper lid relative to the toilet seat about the hinge or plurality of hinges. Preferably, the adjustable height range may be defined from the lower lid relative to the toilet seat about the hinge or plurality of hinges. The users may adjust the height range of the lower lid and/or the upper lid by adjusting the angle relative to the toilet seat to be between 0 degrees to 90 degrees. For short users, the desired angle may be between 0 degrees and 30 degrees. For average height users, the desired angle may be between 30 degrees and 60 degrees. For tall users, the desired angle may be between 60 degrees and 90 degrees.

In some embodiments, seated use of the urinal integrated lid system is substantially identical to that for a standard water closet/toilet seat and lid assembly: the operator should first rotate the urinal integrated lid open, as illustrated in FIG. 3B. To do so, the operator should use their fingers to lift upward on the lids, while the seat remains closed. The operator should rotate the lids to their extreme open position, such that the lids rest adjacent the water tank of the water closet or toilet. The operator may then sit on the toilet seat 310 for seated use of urinal integrated lid system, as illustrated in FIG. 3B.

In some embodiments, toilet cleaning access of the urinal integrated lid system is provided by raising the toilet seat for cleaning the toilet bowl. With the urinal integrated lid beginning in its fully opened or expanded state, as depicted in FIG. 3C, the operator may rotate the toilet seat 310 upward. To do so, the operator should use their fingers to lift upward on the bottom edge of the toilet seat 310 and rotate the toilet seat 310 upward to a vertical position at which point the toilet seat will rest on the urinal integrated lid next to the water tank.

The specification and drawings are to be regarded in an illustrative rather than a restrictive sense. However, it will be evident that various modifications and changes may be made thereunto without departing from the broader spirit and scope of the invention as set forth in the claims. Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a," "an," "the," and similar referents in the context of describing the disclosed embodiments (especially in the context of the following claims) are to be construed to cover both the singular and the plural, unless otherwise indicated or clearly contradicted by context. The terms "comprising," "having," "including," and "containing" are to be construed as open-ended terms (i.e., meaning "including, but not limited to,") unless otherwise noted. The term "connected," where unmodified and referring to physical connections, is to be construed as partly or wholly contained within, attached to, or joined together, even if there is something intervening. Recitation of ranges of values are merely intended to serve as a shorthand method of referring individually to each separate value falling within the range, unless otherwise indicated and each separate value is incorporated into the specification as if it were individually recited. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal.

Conjunctive language, such as phrases of the form "at least one of A, B, and C," or "at least one of A, B and C," is understood with the context as used in general to present that an item, term, etc., may be either A or B or C, or any nonempty subset of the set of A and B and C, unless specifically stated otherwise or otherwise clearly contradicted by context. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, the term "plurality" indicates a state of being plural (e.g., "a plurality of items" indicates multiple items). The number of items in a plurality is at least two, but can be more when so indicated either explicitly or by context.

The use of any examples, or exemplary language (e.g., "such as") provided, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described. Accordingly, the scope of the present disclosure includes all modifications and equivalents of the subject matter recited in the claims appended hereto as permitted by applicable law. Moreover, although above-described elements may be described in the context of certain embodiments of the specification, unless stated otherwise or otherwise clear from context, these elements are not mutually exclusive to only those embodiments in which they are described; any combination of the above-described elements in all possible variations thereof is encompassed by the scope of the present disclosure unless otherwise indicated or otherwise clearly contradicted by context.

All references, including publications, patent applications, and patents, cited are hereby incorporated by reference to the same extent as if each reference were individually and specifically indicated to be incorporated by reference and were set forth in its entirety.

The invention claimed is:

1. A urinal integrated lid system, comprising:

a toilet seat, a lower lid and an upper lid, wherein one or more hinges couple the toilet seat, the lower lid and the upper lid together, wherein:

the lower lid comprises a first portion of a first coupling mechanism, a first side of the upper lid comprises a second portion of the first coupling mechanism and a second side of the upper lid comprises a first portion of a second coupling mechanism, wherein the first side is opposite that of the second side, and the first coupling mechanism comprises a first securing force and the second coupling mechanism comprises a second securing force, wherein the second securing force is greater than the first securing force.

2. The urinal integrated lid system of claim 1, wherein the second securing force is at least 1.25 times greater than the first securing force.

3. The urinal integrated lid system of claim 1, wherein the lower lid comprises a rotational range of no more than 75 degrees with respect to the upper lid.

4. The urinal integrated lid system of claim 1, wherein the lower lid and the upper lid exist together in either an open state or a closed state relative one another.

5. The urinal integrated lid system of claim 4, wherein, when in the closed state, the lower lid and the upper lid form a fluidically sealed cavity therebetween.

6. The urinal integrated lid system of claim 5, wherein the fluidically sealed cavity comprises a plurality of fluid outlet apertures disposed within one or more peripheral surfaces thereof.

7. The urinal integrated lid system of claim 5, wherein actuation of an actuator disposed on an exterior surface of the lower lid or the upper lid executes release of one or more cleansing fluids within the fluidically sealed cavity.

8. The urinal integrated lid system of claim 7, wherein a top portion of the fluidically sealed cavity releases the one or more cleansing fluids and a bottom portion of the fluidically sealed cavity drains the one or more cleansing fluids, and wherein the lower lid comprises a concave shape that slopes downwards from the top portion to the bottom portion.

9. The urinal integrated lid system of claim 4, wherein, when in the open state, the lower lid and the upper lid are separated by an angle of between 45 degrees and 75 degrees relative one another.

10. The urinal integrated lid system of claim 4, wherein a plurality of foldable panels couple the lower lid to the upper lid, and wherein a fluid drain is disposed between the plurality of foldable panels.

11. The urinal integrated lid system of claim 10, wherein, when the lower lid and the upper lid are in the closed state, the plurality of foldable panels exist in a folded state where each of the plurality of foldable panels are stacked upon one another.

12. The urinal integrated lid system of claim 10, wherein, when the lower lid and the upper lid are in the open state, the plurality of foldable panels exist in an extended state where each of the plurality of foldable panels are arranged successively in a common plane.

13. The urinal integrated lid system of claim 1, wherein the first coupling mechanism comprises one or more first latches and the second coupling mechanism comprises one or more second latches.

14. The urinal integrated lid system of claim 1, wherein the first coupling mechanism comprises one or more first magnets and the second coupling mechanism comprises one or more second magnets.

15. The urinal integrated lid system of claim 1, wherein the first coupling mechanism comprises one or more first patches of hook and loop fasteners and the second coupling mechanism comprises one or more second patches of hook and loop fasteners.

16. The urinal integrated lid system of claim 1, further comprising a second portion of the second coupling mechanism.

17. The urinal integrated lid system of claim 16, wherein the second portion of the second coupling mechanism comprises an adhesive layer disposed thereupon.

18. The urinal integrated lid system of claim 16, wherein the second portion of the second coupling mechanism comprises one or more suction cup elements disposed thereupon.

19. A urinal integrated lid system, comprising:

a toilet seat, a lower lid and an upper lid, wherein one or more hinges couple the toilet seat, the lower lid and the upper lid together, wherein:

the lower lid comprises a first portion of a first coupling mechanism, a first side of the upper lid comprises a second portion of the first coupling mechanism and a second side of the upper lid comprises a first portion of a second coupling mechanism, wherein the first side is opposite that of the second side, and the first coupling mechanism comprises a first securing force and the second coupling mechanism comprises a second securing force, wherein the second securing force is greater than the first securing force;

a fluidically sealed cavity formed by the lower lid and the upper lid; and a plurality of foldable panels coupled between the lower lid and the upper lid.

20. A urinal integrated lid system, comprising:

a toilet seat, a lower lid and an upper lid, wherein one or more hinges couple the toilet seat, the lower lid and the upper lid together, wherein:

the lower lid comprises a first portion of a first coupling mechanism, a first side of the upper lid comprises a second portion of the first coupling mechanism and a second side of the upper lid comprises a first portion of a second coupling mechanism, wherein the first side is opposite that of the second side, and the first coupling mechanism comprises a first securing force and the second coupling mechanism comprises a second securing force, wherein the second securing force is greater than the first securing force;

a fluidically sealed cavity formed by the upper lid and the lower lid, wherein the fluidically sealed cavity comprises a plurality of fluid outlet apertures disposed within one or more peripheral surfaces thereof; and a plurality of foldable panels coupled between the lower lid and the upper lid, wherein a fluid drain is disposed between the plurality of foldable panels.

* * * * *